US005606835A

United States Patent [19]

Champagne

[11] Patent Number: 5,606,835

[45] **Date of Patent: *Mar. 4, 1997**

[54] PUSH TAB FOR SIDING

[75] Inventor: Wendel J. Champagne, Tomball, Tex.

[73] Assignee: Tommy W. Hollis, Conroe, Tex.

[ * ] Notice: The term of this patent shall not extend beyond the expiration date of Pat. No. 5,564,246.

[21] Appl. No.: 285,320

[22] Filed: Aug. 3, 1994

[51] Int. Cl.[6] ..... E04D 1/34

[52] U.S. Cl. ..... 52/545; 52/543; 52/520; 52/712

[58] Field of Search ..... 52/520, 543–545, 52/547, 548, 552, 506.05, 478, 489.1, 489.2, 551, 712

[56] References Cited

U.S. PATENT DOCUMENTS

| | | | |
|---|---|---|---|
| 2,490,663 | 12/1949 | Van Uum et al. | 52/551 X |
| 2,591,361 | 4/1952 | Knott | 52/489.1 |
| 2,916,113 | 12/1959 | Lee . | |
| 3,020,988 | 2/1962 | Bransford | 52/512 |
| 3,106,411 | 10/1963 | Holmes | 52/489.1 |
| 3,131,513 | 5/1964 | Grigas et al. | 52/55 X |
| 3,154,889 | 11/1964 | Monroe | 52/520 X |
| 3,824,756 | 7/1974 | Kessler | 52/548 |
| 4,096,679 | 6/1978 | Naz | 52/551 |
| 4,348,849 | 9/1982 | Wollam et al. | 52/545 |
| 4,424,655 | 1/1984 | Trostle | 52/520 |
| 4,467,579 | 8/1984 | Weinar | 52/489.2 X |
| 4,641,473 | 2/1987 | Trezza | 52/506.05 X |
| 4,854,101 | 8/1989 | Champagne . | |
| 4,947,609 | 8/1990 | Champagne | 52/545 |
| 5,274,978 | 1/1994 | Perkonigg et al. | 52/547 |
| 5,325,641 | 7/1994 | Felton | 52/489.1 X |
| 5,339,608 | 8/1994 | Hollis et al. | 52/545 |

FOREIGN PATENT DOCUMENTS

| | | | |
|---|---|---|---|
| 0571607 | 8/1945 | United Kingdom | 52/489.1 |
| 0620263 | 3/1949 | United Kingdom | 52/489.1 |

*Primary Examiner*—Robert Canfield
*Attorney, Agent, or Firm*—John R. Casperson

[57] ABSTRACT

There is disclosed a panel clip for siding. The clip is especially useful for installing a top siding row on a next to top siding row. The clip has a first face and a second face. The clip is formed from a continuous metal strip. The clip has a generally J-shaped portion and a generally inverted V-shaped portion. The generally J-shaped portion has a first end corresponding to an upper end of the J and a second end corresponding to a tail end of the J. The generally inverted V-shaped portion has an apex, a first end, a first leg extending between the apex and the first end, a second end, and a second leg extending between the apex and the second end. Each leg has a first face and a second face corresponding to the first face and the second face of the continuous metal strip. The first end of the generally inverted V-shaped portion is connected to the second end of the generally J-shaped portion to form a generally S-shaped bend with the second leg of the generally inverted V-shaped portion. The second leg of the inverted generally V-shaped portion forms a hood portion which covers the second end of the generally J-shaped portion. When the clip further has at least one outwardly facing barb extending from the second face of the second upright leg in order to be self fastening, the at least one barb is covered by the hood portion to reduce the risk of injury to the siding installers. In other embodiments of the invention, the clips can be nailed to the wall portion being covered. The holding power of the clips can be enhanced by providing the clips with a point on the hood portion and engaging the point on each hood portion with a portion of the next-to-top row panel.

11 Claims, 1 Drawing Sheet

PUSH TAB FOR SIDING

BACKGROUND OF THE INVENTION

This invention relates to a mounting clip for joining siding panels. In one aspect, this invention relates to a mounting clip for mounting vinyl siding panels to each other. In another aspect, this invention relates to a clip for mounting the top siding row to the next to top siding row. In yet another aspect, this invention relates to a method for joining siding panels.

There are numerous reasons the building industry has had a preference for the use of vinyl siding. These reasons include, but are not restricted to, the fact that such siding has low wear and maintenance characteristics. Vinyl panels are generally extruded or formed into individual panels 12 feet long and 8 or 10 inches wide. Each panel is profiled to simulate one or more rows of the traditional lapped wooden siding and can even have a textured finish to complete the illusion of wooden siding. The panels are made with permanent coloring and with a variety of surface finishes all leading to the above mentioned low maintenance characteristics.

The rows of vinyl siding are traditionally installed with the panels in overlapping and/or interlocking rows starting from the bottom of the wall. Each panel has an inturned bottom butt which is received in a downwardly directed channel configuration of the upper butt of the adjacent panel. The panel used at the top of a section of wall can be either a specially formed panel or, more likely, a standard panel modified to remove at least the upper butt and what ever panel surface necessary to make a proper fit. The lower edge of this panel engages the butt of the upper most row of the siding and its upper edge is received under the bottom lip of a finish trim. This is where there has been a problem in the past in that these top out panels do not have the upper nail strip of the standard panels which cover the remainder of the wall. No vinyl panel, regardless of its configuration, can have nails driven through the face. This would clearly mar the finished appearance while preventing the relative movement of the panels which is necessary to accommodate for differences in expansion and contraction due to changes in ambient temperature conditions.

A clip to hold a panel above another panel, especially a clip to hold a topout panel above a next to top row panel, would be very desirable.

OBJECTS OF THE INVENTION

It is an object of this invention to provide a clip for joining siding panels.

It is another object of this invention to provide such a clip that does not require special tools to install.

It is another object of this invention to provide a clip that is especially well adapted to join an upper panel to a lower panel.

It is another object of this invention to provide a clip that is especially well adapted to join a topout panel to a next to top row panel.

It is another object of this invention to provide a clip for joining panels that is safe to use.

SUMMARY OF THE INVENTION

In accordance with certain aspects of the invention, there is provided a mounting clip for siding. The clip has a first face and a second face. The clip is formed from a continuous metal strip. The clip has a generally J-shaped portion and a generally inverted U-shaped portion. The generally J-shaped portion has a first end corresponding to an upper end of the J and a second end corresponding to a tail end of the J. The generally inverted U-shaped portion has an apex, a first end, a first leg extending between the apex and the first end, a second end, and a second leg extending between the apex and the second end. Each leg has a first face and a second face corresponding to the first face and the second face of the continuous metal strip. The first end of the generally inverted U-shaped portion is connected to the second end of the generally J-shaped portion to form a generally S-shaped bend. The second leg of the inverted generally U-shaped portion forms a hood portion which covers the second end of the generally J-shaped portion. When the clip further has at least one outwardly facing barb extending from the second face of the second upright leg in order to be self fastening, the at least one barb is covered by the hood portion to reduce the risk of injury to the siding installers.

DETAILED DESCRIPTION OF THE PREFERRED EMBODIMENTS

Figure 1:
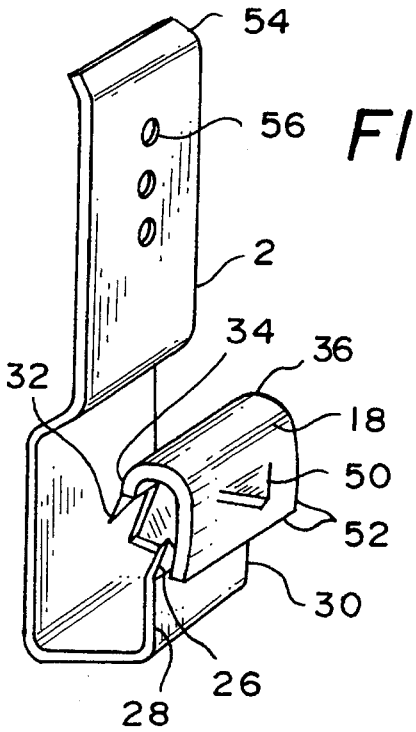
FIG. 1 is a pictorial representation of a clip embodying certain aspects of the present invention.
Figure 2:
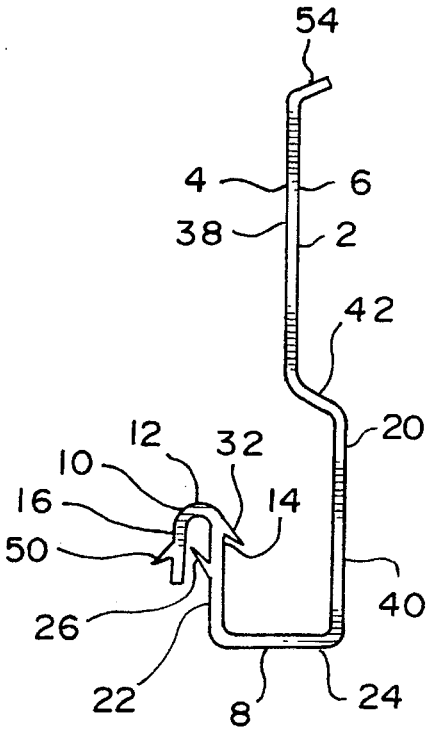
FIG. 2 is a side view of the clip of FIG. 1.
Figure 3:
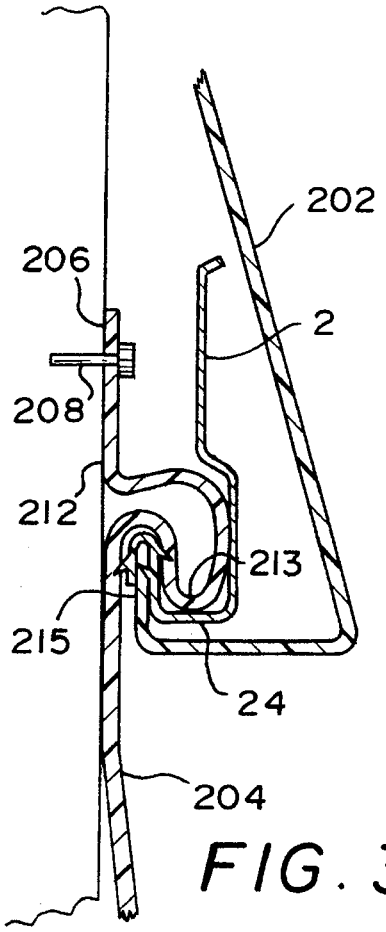
FIG. 3 is a side sectional view of a clip as shown in FIG. 1 being used to position a panel above another panel.
Figure 4:
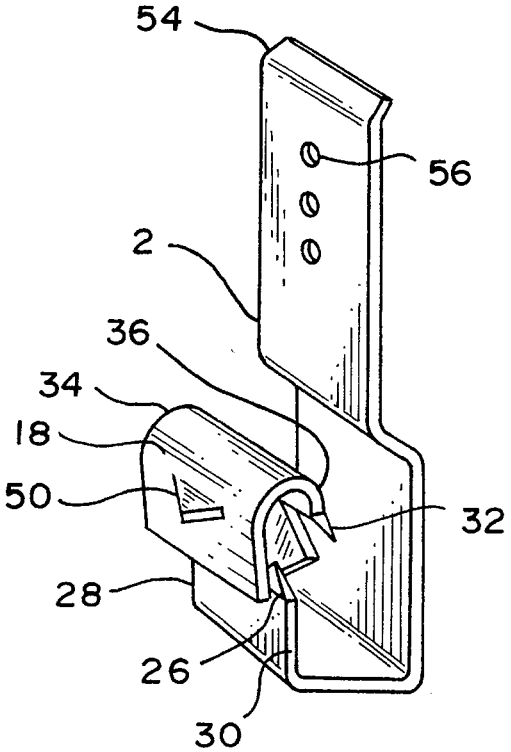
FIG. 4 is a reverse view of the clip shown in FIG. 1.

In accordance with certain aspects of the invention, there is provided a mounting clip 2 for siding. The clip 2 has a first face 4 and a second face 6. The clip is formed from a continuous metal strip. The clip has a generally J-shaped portion 8 and a generally inverted V-shaped portion 10. The generally J-shaped portion 8 has a first end corresponding to an upper end of the J and a second end corresponding to a tail end of the J. The generally inverted U-shaped portion preferably V-shaped 10 has an apex 12, a first end, a first leg 14 extending between the apex and the first end, a second end, and a second leg 16 extending between the apex and the second end. Each leg has a first face and a second face corresponding to the first face and the second face of the continuous metal strip. The first end of the generally inverted U-shaped portion is connected to the second end of the generally J-shaped portion to form a generally S-shaped bend. The second leg 16 of the inverted generally U-shaped portion forms a hood portion 18 which covers the second end of the generally J-shaped portion.

In one embodiment of the invention, the generally J-shaped portion 8 has a long upright leg 20, a short upright leg 22, and a generally U-shaped leg 24 connecting the long upright leg 20 with the short upright leg 22. Each leg has a first face and a second face corresponding to the first face and second face of the strip. The clip is preferably provided with at least one outwardly facing barb 26 extending from the second face of the short upright leg 22. The at least one outwardly facing barb 26 points toward the apex 12 of the inverted generally U-shaped portion. The hood portion 18 is positioned in covering relationship with the at least one outwardly facing barb 26. More preferably, the at least one outwardly facing barb 26 comprises a first triangular barb positioned adjacent to a first side edge 28 of the short upright leg 22 and a second triangular barb positioned adjacent to a second side edge 30 of the short upright leg 22. Most preferably, the clip further has at least one inwardly extending barb 32 extending from the first face of the first leg 14 of the inverted U-shaped portion 10. The at least one inwardly extending barb points away from the apex 12 of the inverted U-shaped portion. Preferably, the at least one inwardly extending barb 32 comprises a third triangular barb positioned adjacent to a first side edge 34 of the first leg 14 of the inverted generally U-shaped portion and a fourth triangular barb positioned adjacent to a second side edge 36 of the first leg 14 of the inverted generally U-shaped portion. Most preferably, each of the triangular barbs is formed from a portion of the strip and is oriented at an angle in the range of from about 30 degrees to about 60 degrees with respect to the face of the strip from which it extends. The inwardly extending barbs make the clips self fastening.

With a self fastening clip, the length of the long upright leg of the clip is not particularly critical. In the illustrated embodiment of the invention, the long upright leg 20 comprises a first generally straight section 38, a second generally straight section 40, and a bent section 42 connecting the first generally straight section 38 with the second generally straight section 40. Each section has a first end and a second end and a first face and an oppositely facing second face corresponding with the first face and the second face of the continuous metal strip. The bent section 42 connects the second end of the first generally straight section 38 with the first end of the second generally straight section 40. The first face of the bent section 42 faces the first face of the short upright section 22. The second end of the second generally straight section 40 is connected to the first end of the generally U-shaped leg 24. The first generally straight section 38 and the second generally straight section 40 are preferably positioned in generally parallel planes.

In a most preferred embodiment of the invention, the clip 2 further has at least one outwardly extending barb 50 extending from the first face of the second leg 16 of the inverted U-shaped portion 10. The at least one barb 50 is preferably positioned at a location spaced apart from a perimeter 52 of the second leg 16 of the inverted U-shaped portion 10. The at least one outwardly extending barb 50 points toward the second end of the second leg 16 of the inverted generally V-shaped portion. Most preferably, the outwardly extending barb 50 comprises a triangular barb formed from a portion of the strip and oriented at an angle in the range of from about 30 degrees to about 60 degrees with respect to the first face.

Preferably, the mounting clip further has a short bent section 54 positioned at the first end of the first generally straight section 38 of the long upright leg 6 of the clip. The short bent section is preferably connected to the first generally straight section at an angle in the range of from about 30 degrees to about 60 degrees and is bent toward the second face of the strip, to facilitate handling.

Although the clip will be self fastening for many applications, it can be provided with at least one borehole 56 extending from the first face to the second face of the first generally straight section 38 of the long upright leg, to provide for fastening by nailing.

It is important that the clip have adequate spring strength to perform its function. For vinyl siding, a mounting which is formed from stainless steel spring stock will provide good results. The blank stock can have a length in the range of about 0.5 inches to about 4 inches, preferably about 1 inch to about 3 inches and a width in the range of about 0.25 inches to about 3 inches, preferably about 0.5 inches to about 1 inch, and a thickness in the range of from about 0.003 inches to about 0.020 inches, preferably about 0.009 inches to about 0.012 inches. An exemplary clip can be formed from 2.5×0.5×0.015 inch stock.

In another embodiment of the invention, there is provided a method for mounting a top row 202 of siding panels to a next-to-top row 204. The next-to-top row of siding panels 204 is secured to a wall portion to be covered by siding panels. This can be accomplished by nailing the row utilizing a nail hem 206 and at least one nail 208. A plurality of clips 2 are mounted spaced along a top edge 212 of said next-to-last row panel. Each such clip can be as described above. The first face of the generally U-shaped leg 24 of each clip 2 contacts a top butt portion 213 of the next-to-top row panel 204. The top out panel 202 is mounted by inserting its upper edge under a soffit panel and engaging a bottom butt 215 of the top out panel 202 with the at least one outwardly facing barb of each clip. Where each mounting clip further comprises at least one inwardly extending barb extending from the first face of the second upright leg, pointing toward the first U-shaped bight, the clips may be mounted by pressing the generally U-shaped section of each clip over the top butt portion of the next-to-top row panel. This will engage the at least one inwardly extending barb with the top butt portion of said next-to-top row panel. In other embodiments of the invention, the clips can be nailed to the wall portion being covered. The holding power of the clips can be enhanced by providing the clips with a point on the hood portion and engaging the point on each hood portion with a portion of the next-to-top row panel.

I claim:

1. A mounting clip for siding comprising a continuous metal strip having a first face, a second face, a generally J-shaped portion and a generally inverted U-shaped portion, said generally J-shaped portion having a first end corresponding to an upper end of the J-shape and a second end corresponding to a tail end of the J-shape, the generally inverted U-shaped portion having an apex, a first end, a first leg extending between the apex and the first end, a second end, and a second leg extending between the apex and the second end, each leg having a first face and a second face corresponding to the first face and the second face of the continuous metal strip, the first end of the generally inverted U-shaped portion being connected to the second end of the generally J-shaped portion thus forming a generally S-shaped bend with the second leg of the generally inverted U-shaped portion forming a hood portion which covers the second end of the generally J-shaped portion, wherein the generally J-shaped portion has a long upright leg, a short upright leg, and a generally U-shaped leg connecting the long upright leg with the short upright leg, each such leg having a first face and a second face corresponding to the first face and second face of the strip, and said continuous metal strip further has a first barb means facing outwardly and extending from the second face of the short upright leg, said first barb means pointing toward the apex of the inverted generally U-shaped portion, said hood portion being positioned in covering relationship with the first barb means;

wherein the first barb means comprises a first triangular barb positioned adjacent to a first side edge of the short upright leg and a second triangular barb positioned adjacent to a second side edge of the short upright leg; and wherein said continuous metal strip further has a second barb means facing inwardly and extending from the first face of the first leg of the inverted U-shaped portion, said second barb means pointing away from the apex of the inverted U-shaped portion.

2. A mounting clip as in claim 1 wherein the second barb means comprises a third triangular barb positioned adjacent to a first side edge of the first leg of the inverted generally U-shaped portion and a fourth triangular barb positioned adjacent to a second side edge of the first leg of the inverted generally U-shaped portion.

3. A mounting clip as in claim 1 wherein the long upright leg comprises a first generally straight section having a first end and a second end and a second generally straight section having a first end and a second end and a bent section connecting the second end of the first generally straight section with the first end of the second generally straight section, each section having a first face and an oppositely facing second face corresponding with the first face and the second face of the continuous metal strip, wherein the first face of the bent section faces the first face of the short upright leg and the second end of the second generally straight section is connected to the first end of the generally U-shaped leg.

4. A mounting clip as in claim 3 wherein the first generally straight section and the second generally straight section are positioned in generally parallel planes.

5. A mounting clip in claim 4 wherein each triangular barb is formed from a portion of the strip and is oriented at an angle in the range of from about 30 degrees to about 60 degrees with respect to the face of the strip from which it extends.

6. A mounting clip as in claim 2 wherein the continuous metal strip further has a third barb means facing outwardly and extending from the first face of the second leg of the inverted U-shaped portion at a location spaced apart from a perimeter of the second leg of the inverted U-shaped portion of the strip, said third barb means pointing toward the second end of the second leg of the inverted generally U-shaped portion.

7. A mounting clip as in claim 6 wherein the third barb means comprises a triangular barb formed from a portion of the strip and oriented at an angle in the range of from about 30 degrees to about 60 degrees with respect to the first face.

8. A mounting clip for siding comprising a continuous metal strip having a first face, a second face, a generally J-shaped portion and a generally inverted U-shaped portion, said generally J-shaped portion having a first end corresponding to an upper end of the J-shape and a second end corresponding to a tail end of the J-shape, the generally inverted U-shaped portion having an apex, a first end, a first leg extending between the apex and the first end, a second end, and a second leg extending between the apex add the second end, each leg having a first face and a second face corresponding to the first face and the second face of the continuous metal strip, the first end of the generally inverted U-shaped portion being connected to the second end of the generally J-shaped portion thus forming it generally S-shaped bend with the second leg of the generally inverted U-shaped portion forming a hood portion which covers the second end of the generally J-shaped portion wherein the generally J-shaped portion has a long upright leg, a short upright leg, and a generally U-shaped leg connecting the long upright leg with the short upright leg, each such leg having a first face and a second face corresponding to the first face and second face of the strip, and said continuous metal strip further has at least one outwardly facing barb extending from the second face of the short upright leg, said at least one outwardly facing barb pointing toward the apex of the inverted generally U-shaped portion, said hood portion being positioned in covering relationship with the at least one outwardly facing barb, wherein the long upright leg comprises a first generally straight section having a first end and a second end and a second generally straight section having a first end and a second end and a bent section connecting the second end of the first generally straight section with the first end of the second generally straight section, each section having a first face and an oppositely facing second face corresponding with the first face and the second face of the continuous metal strip, wherein the first face of the bent section faces the first face of the short upright leg and the second end of the second generally straight section is connected to the first end of the generally U-shaped leg, and the continuous metal strip further has a short bent section positioned at the first end of the first generally straight section of the long upright leg of the strip, said short bent section being connected to the first generally straight section at an angle in the range of from about 30 degrees to about 60 degrees, said short bent section being bent toward the second face of the strip.

9. A mounting clip as in claim 3 wherein at least one borehole extending from the first face to the second face is defined in the first generally straight section of the long upright leg of the strip.

10. A mounting clip as in claim 1 which is formed from stainless steel spring stock having a length in the range of about 0.5 inches to about 4 inches and a width in the range of about 0.25 inches to about 3 inches and a thickness in the range of from about 0.003 inches to about 0.020 inches.

11. A mounting clip as in claim 1 which is formed from stainless steel spring stock having a length in the range of about 1 inch to about 3 inches and a width in the range of about 0.5 inches to about 1 inch and a thickness in the range of from about 0.009 inches to about 0.015 inches.

* * * * *